United States Patent [19]

Hajjar

[11] Patent Number: 5,020,290

[45] Date of Patent: Jun. 4, 1991

[54] MODULAR WALL

[76] Inventor: Victor J. Hajjar, 1600 Galen Rd., Harrisburg, Pa. 17110

[21] Appl. No.: 451,011

[22] Filed: Dec. 15, 1989

[51] Int. Cl.[5] ..... E04B 2/78; E04H 1/00

[52] U.S. Cl. ..... 52/242; 52/241; 52/287

[58] Field of Search ..... 52/241, 242, 243, 288, 52/287, 239, 238.1

[56] References Cited

U.S. PATENT DOCUMENTS 1,981,240 11/1934 McNeil ..... 52/242
3,228,160 1/1966 O'Brien ..... 52/242
3,925,948 12/1975 Sauer et al. ..... 52/242
4,080,766 3/1978 Jastrabek ..... 52/242

*Primary Examiner*—Michael Safavi
*Attorney, Agent, or Firm*—Allan B. Osborne

[57] ABSTRACT

A kit structure for erecting an interior wall within a building or the like has been disclosed. More particularly, the structure includes horizontal member to be attached to a floor and ceiling, vertical members extending between the horizontal members to brace panels placed on the wall, support members in the floor-attached member for supporting the panels and trim strips for concealing the other components and edges of the panel.

3 Claims, 7 Drawing Sheets

MODULAR WALL

FIELD OF THE INVENTION

The invention disclosed herein relates to structural elements which, when assembled, form an interior wall which appears permanent but may be quickly and easily disassembled if required.

BACKGROUND OF THE INVENTION

Structural elements for constructing walls within a building or the like are know from U.S. Pat. No. 3,821,868. In this disclosure, the structural elements, which constitute a plural-sided frame, includes parallel, transversely-spaced grooves which accommodate the edges of transversely-spaced panels. A primary disadvantage however is that the panels must be inserted into the grooves before assembling the walls and the walls must be disassembled before the panels can be removed. These and other disadvantages were overcome in application U.S. Ser. No. 07/177,334, where structural elements included retaining clips which retained the panels in place. Thus, to change panels, one simply and easily removed the clips, replaced the panels and reinserted the clips. Disassembly of the walls is substantially facilitated also by reason of being able to remove the panels first.

It is now proposed to provide a wall wherein trim strips are included which conceal the edges of the panels which are placed on the walls. Further, the main structural members include raceways for electrical wiring harnesses.

SUMMARY OF THE INVENTION

According to the invention, an interior wall kit is provided which includes horizontal members for attaching to the floor and ceiling in registration with each other, vertical members extending between the horizontal members to provide backing for panels placed thereagainst, support members placed in the floor attached member to support the panels, trim strips for concealing the other components and the edges of the panels and clips for holding the trim strips.

BRIEF DESCRIPTION OF THE DRAWINGS

FIG. 7 is a perspective view of a ceiling corner member; and

DESCRIPTION OF THE INVENTION

Figure 1:
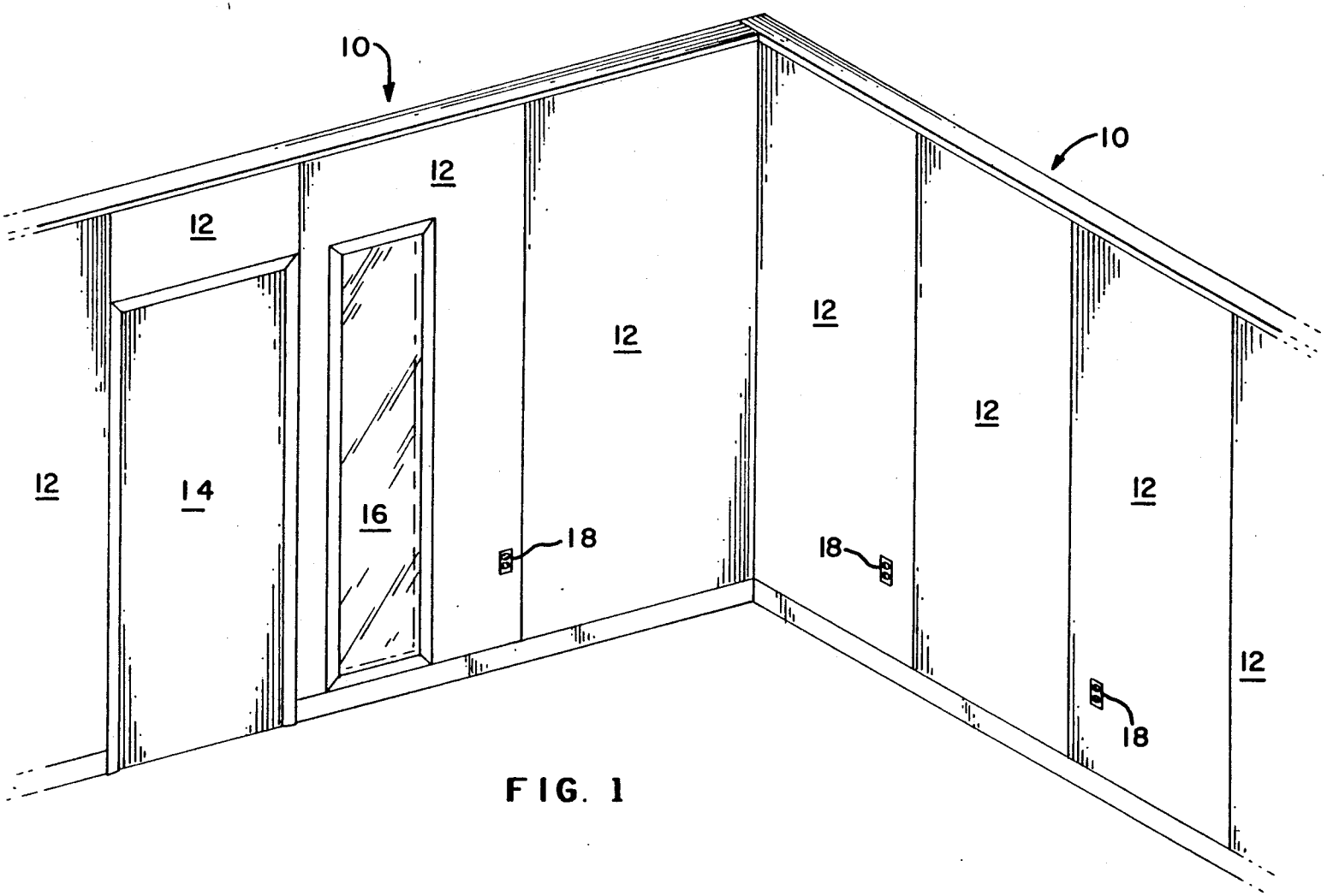
FIG. 1 is a view of a wall assembled in accordance with the present invention.
Figure 2:
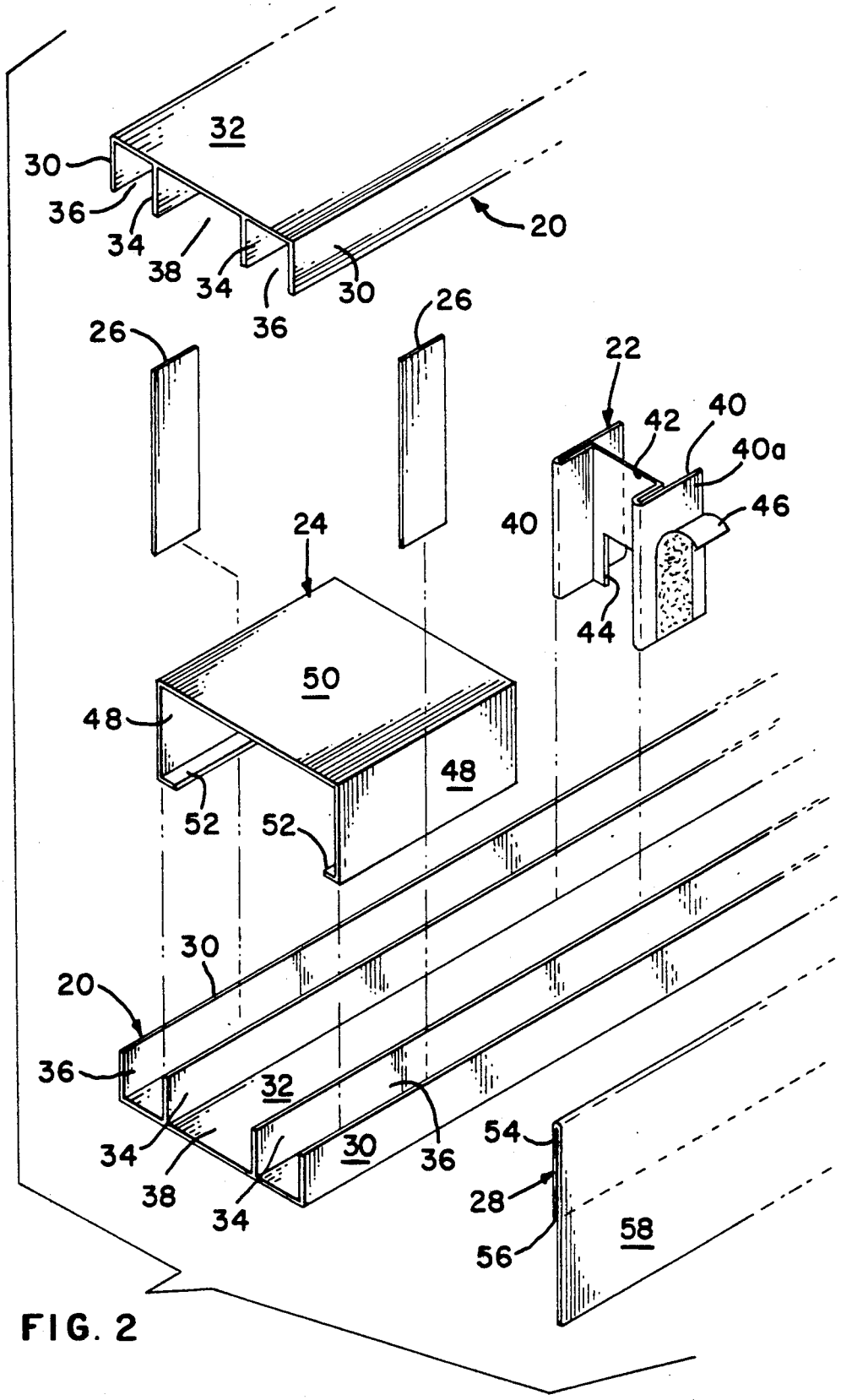
FIG. 2 is a perspective view of a segment of wall of FIG. 1 without the covering panels.

FIG. 1 illustrates a pair of walls 10*a*, 10*b* (collectively walls 10) which are at right angles to each other and are assembled from the components shown in FIG. 2. Each wall 10 includes the basic components which are quickly and easily assembled (and disassembled) by non-skilled workmen with only the very basic tools. Wall 10*a* includes door 14 and a glass window 16. Further, as indicated by electrical receptacles 18, walls 10 provide wiring raceways for task lighting, power, communications and electronic equipment; e.g., personal computers.

The components used in assembling walls 10 are shown in FIG. 2 and include elongated horizontal members 20, vertical members 22, support members 24, trim retaining clips 26 and trim strips 28.

Horizontal member 20 are channel-shaped as defined by sidewalls 30 and floor 32. Additionally, a pair of interior partitions 34 are provided between sidewalls 30. As shown, partitions 34 are spaced inwardly from sidewalls 30 as well as being spaced from each other to define respectively outer channel 36 and center channel 38.

Vertical members 22 have an I beam shape as defined by spaced apart, parallel face plates 40 and intervening support plate 42 normal thereto. Cut-outs 44 are provided in each end of plate 42 (shown in one end only). As shown, members 22 are formed from a single piece of sheet metal. Vertical members 22 also include securing strips 46; e.g., Velcro, on the outer surface of plates 40, as indicated by reference number 40*a*.

Support members 24 are U-shaped and include legs 48 joined by bight 50. Lips 52 project inwardly from the free edges of legs 48.

Trim retaining clips 26 are rectangular pieces having a predetermined thickness as will be noted below.

Trim strips 28 are double layered with an inner portion 54 being formed from a flat length of material by bending it over 180° and thereby forming a pocket 56 in cooperation with outer portion 58. As illustrated, inner portion 54 overlaps outer portion 58 just enough to form pocket 56.

Preferably, the several components are made from steel and are either extruded (horizontal members 20 and support members 24), stamped and formed (vertical members 22, trim strips 28), or cut from flat stock (clips 26). All of the components may be cut to specified lengths at the mill or shipped to a job site in long lengths and readily cut to length as required at the site.

Figure 3:
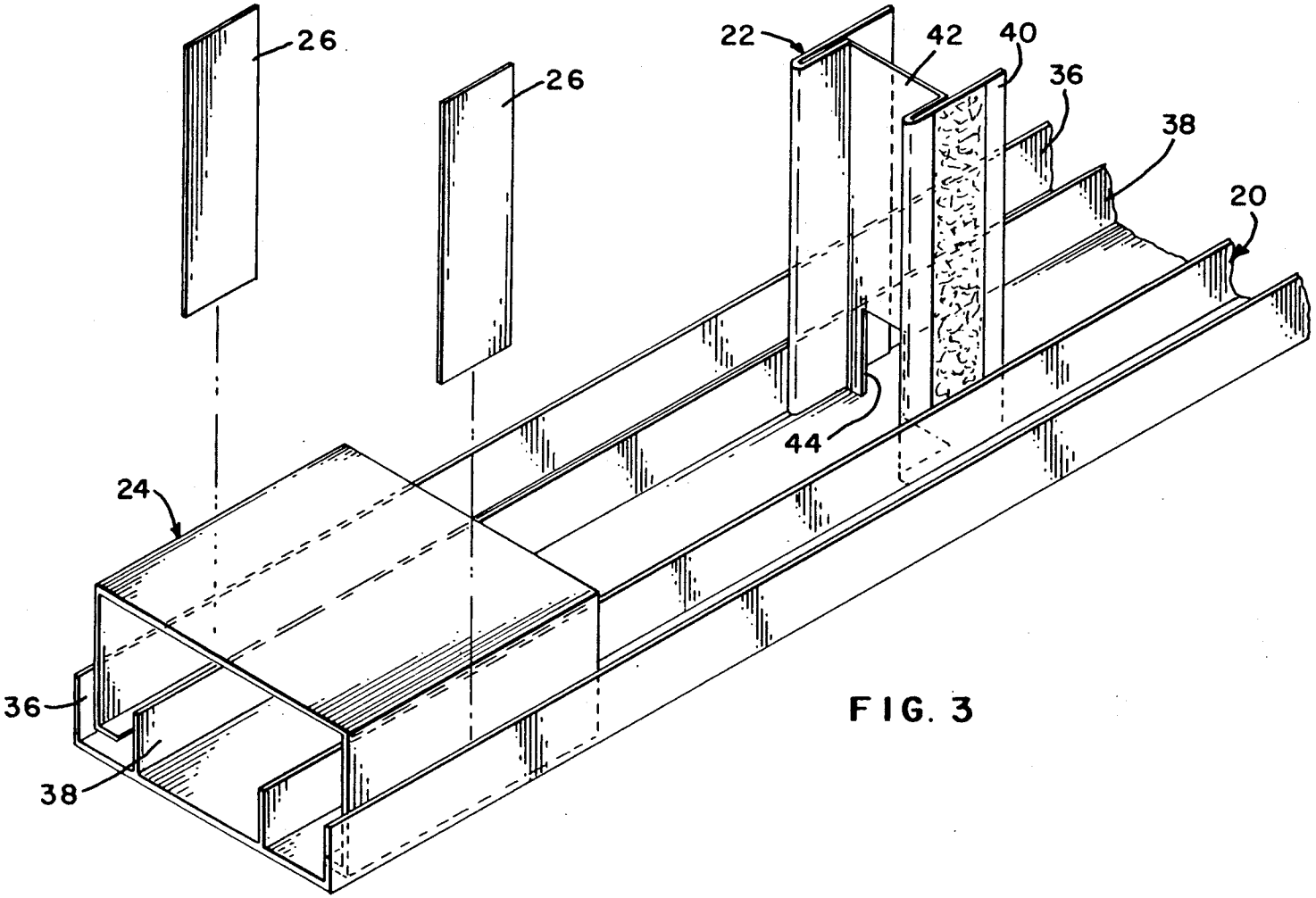
FIG. 3 is a perspective view showing several structural elements assembled together.

The steps in assembling a wall 10 are straight forward. With reference to FIG. 3, horizontal members 20; i.e., floor members 20, are laid down on a floor (not shown), and are secured thereto by means of any conventional fastening techniques; e.g. by nailing. Similarly, horizontal members 20 are attached to the ceiling (not shown) i.e., ceiling members 20, in overlying registration with floor members 20. Vertical members 22 are next put into place between floor and ceiling members 20 on a predetermined spacing therebetween; e.g. on two foot centers. Vertical members 22 are located in channels 38, as shown, with the fit preferably being frictional. Support members 24, which are of a short length (four inches more or less), are positioned between each vertical member 22. Legs 48 are received in respective outer channels 36 with lips 52 resting on floor 32. The outside width of support members 24 is equal to the width between sidewalls 30 less twice the thickness of a trim clip 26. Thus, upon inserting a clip 26 on each side of a support member 24, both clips 26 and member 24 are frictionally secured in members 20.

Figure 4:
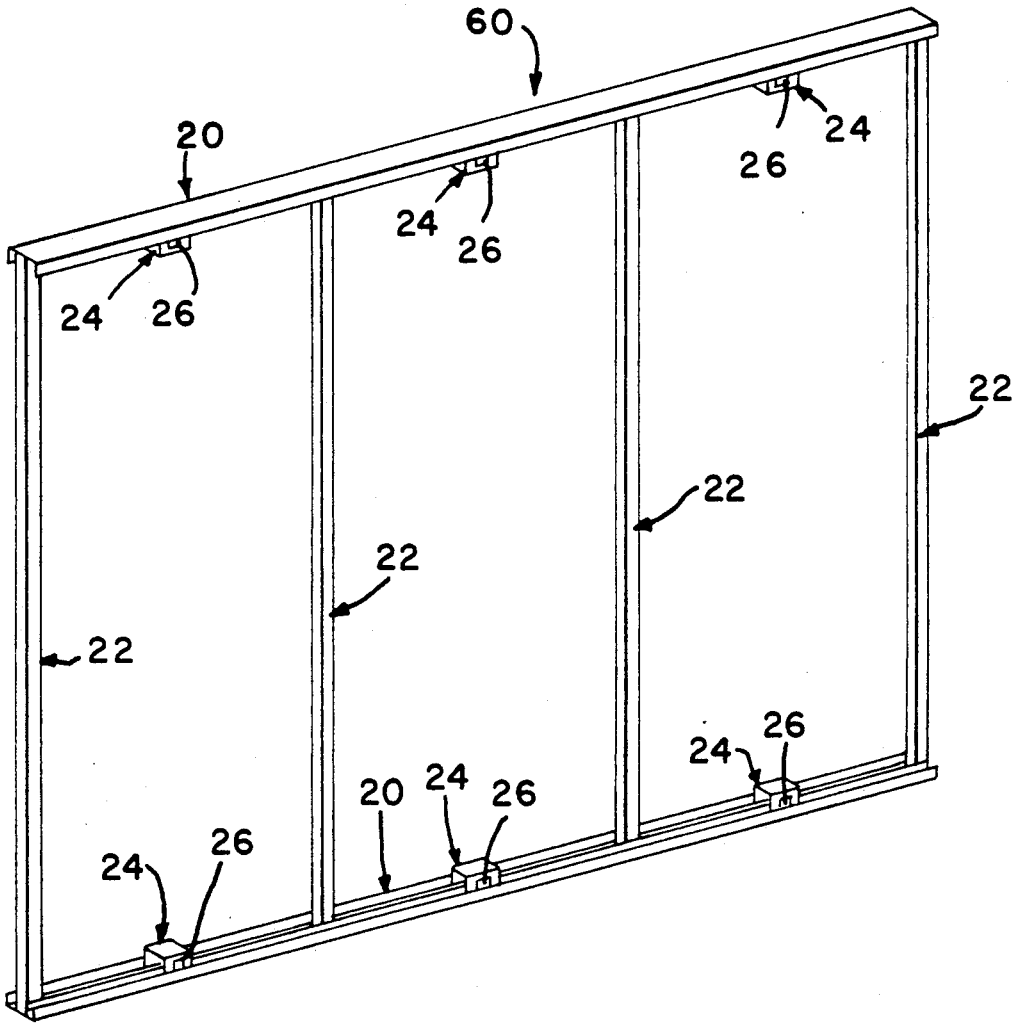
FIG. 4 is a perspective view of a partially assembled wall.

FIG. 4 shows frame 60 formed as described above.

Figure 5:
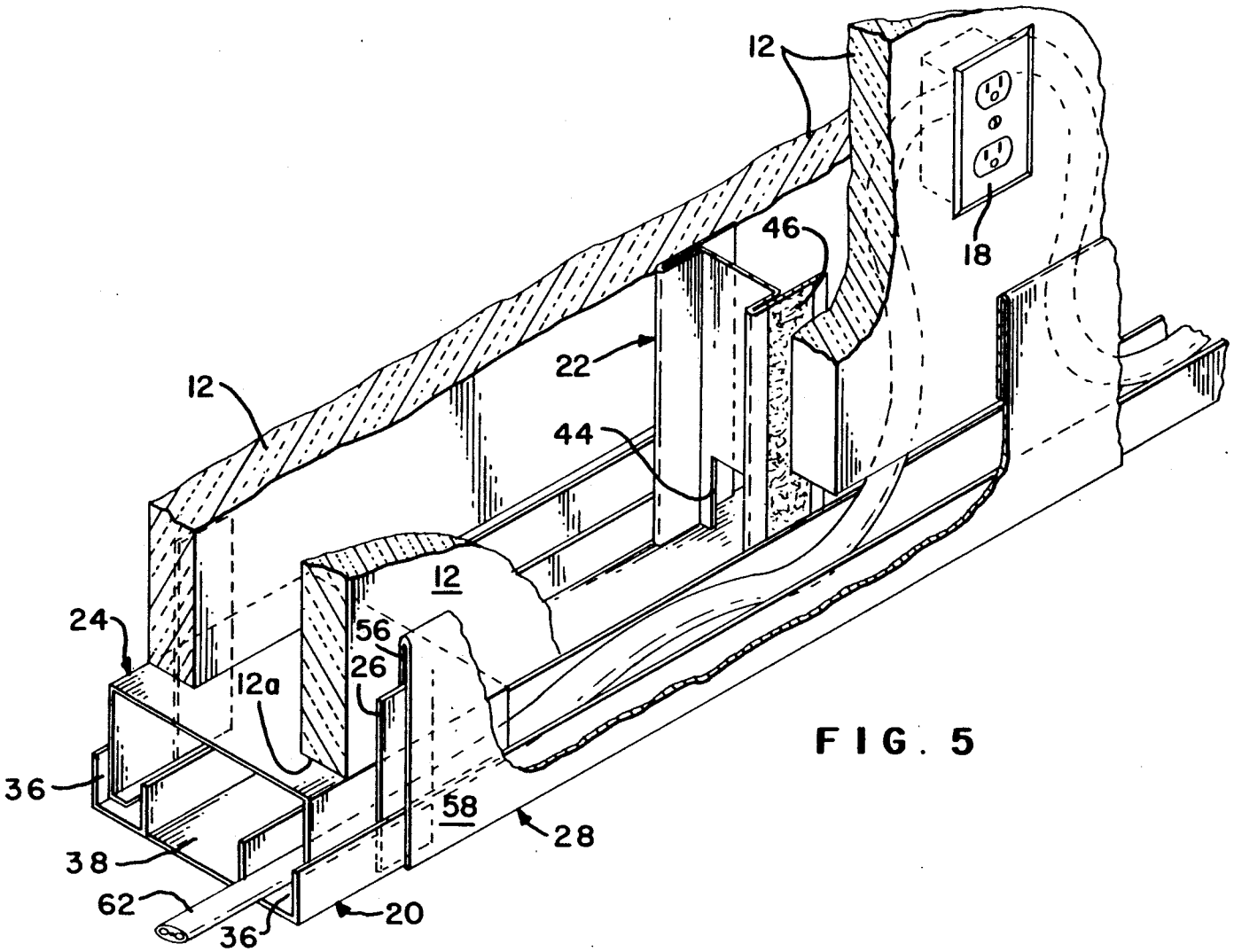
FIG. 5 is a perspective view showing the details of wiring and adding panels and trim strips to the wall of FIG. 4.

The final stage in assembling wall 10 is shown in FIG. 5. An electrical harness (not shown) or wire 62 is laid in either channel 36 (as shown) or 38. In the event center channel 38 is used, wire 62 passes through cut-outs 44 in members 22. In addition to power lines, other wires (not shown) may also be laid in channels 36,38 as noted above; e.g., telecommunications lines, computer cable, etc.

Figures 6A, 6B:
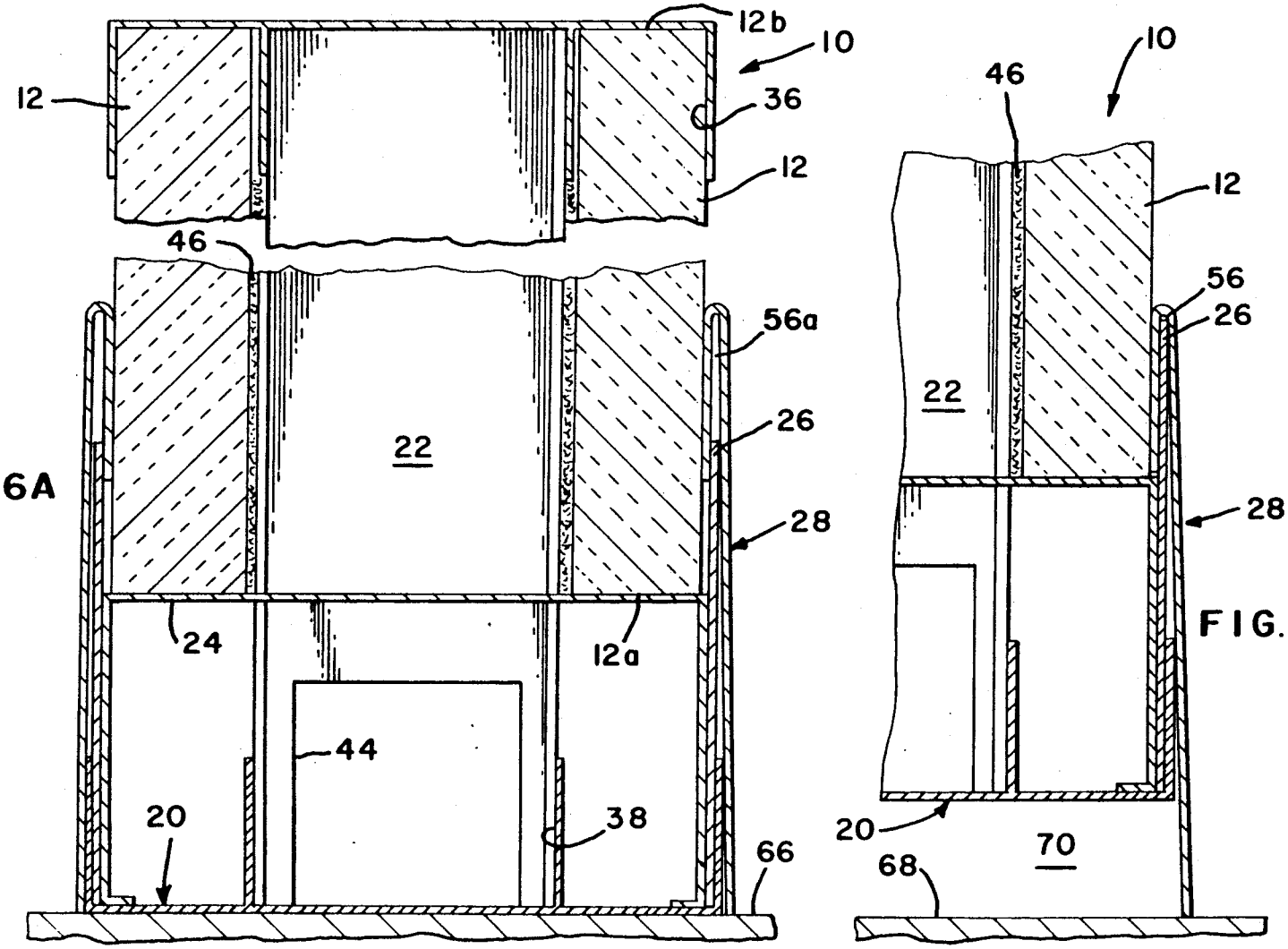
FIGS. 6A and 6B are end sectional views showing the wall on a level floor and uneven floor respectively.

If Velcro strips 46 are used on vertical members 22, then cooperating Velcro strips (not shown) are placed on panels 12 at each side. Panels 12 are placed on frame 60 with panel lower edges 12*a* resting on support members 24. The panel upper edges 12*b* enter channels 36 in ceiling members 20, as shown in FIG. 6A. Velcro strips 46 cooperate in holding panels 12 in position. If desired, tapes and adhesives (not shown) may be used in place of Velcro strips 46.

With panels 12 in position, trim strips 28 are added and secured in place by being pushed down so that trim clips 26 enter pockets 56. As shown in FIG. 5, strips 28 completely cover the other components of frame 60 which might be otherwise visible. Similarly, strips 28 may be secured on top of frame 60 in the same manner to hide any visible components. Trim strips 28 are preferably color coordinated with panels 12 to provide a pleasing decor.

A particularly important advantage offered by the present invention is that trim strips 28 can be easily removed and replaced to access wiring channels 36,38. Thus, wires 62 can be replaced, added to and so forth without requiring extensive disassembly and without disturbing panels 12.

As is quite common, floors, particularly concrete floors, are sometimes uneven such that gaps appear when an elongated floor member 20 is laid down. FIG. 6A shows a view of a level floor 66 and FIG. 6B shows an uneven floor 68. In the former case, floor members 20 and trim strips 28 are flush with floor 66 throughout. Contra, gap 70 (greatly magnified for illustrational purposes) exists between uneven floor 68 and member 20. However, gap 70 can be hidden by sliding trim strip 28 further down onto clips 26.

This can be seen by comparing FIG. 6A with 6B. In the former, space 56*a* exists in pocket 56 above clip 26. In FIG. 6B, trim strip 28 has been moved down to touch floor 68 and thus further onto clip 26.

It may be in some situations that an end 20*a* of ceiling member 20 would be exposed; i.e., the ends of sidewalls 30, floor 32 and partitions 34 would be visible, as illustrated in FIG. 7. Cover 72, shown in FIG. 7, provides one way to cover end 20*a* in those cases where trim strips 28 are not used along the top of wall 10. Cover 72 is L-shaped in cross-section, as defined by perpendicular short legs 74 and sides 76. Further, cover 72 includes two arms 78,80 which are at right angles to each other. Cover 72 is fixed in place by sliding legs 74 between the ceiling (not shown) and member 20 so that side 76 covers end 20*a* and arm 80 extends along one side of member 20 for a short distance. The double arm 78,80 structure of cover 72 provides a more stable attachment than would a single arm 78 structure, which could be used. This is particularly so by making the angle between arms 78,80 less than 90° which the beveled ends 74*a* of sides 74 will permit. Thus, the pre-loaded arms 78,80 will be resiliently spread apart when cover 72 is put in place and thereby exert a closing force against ceiling member 20.

Figure 8:
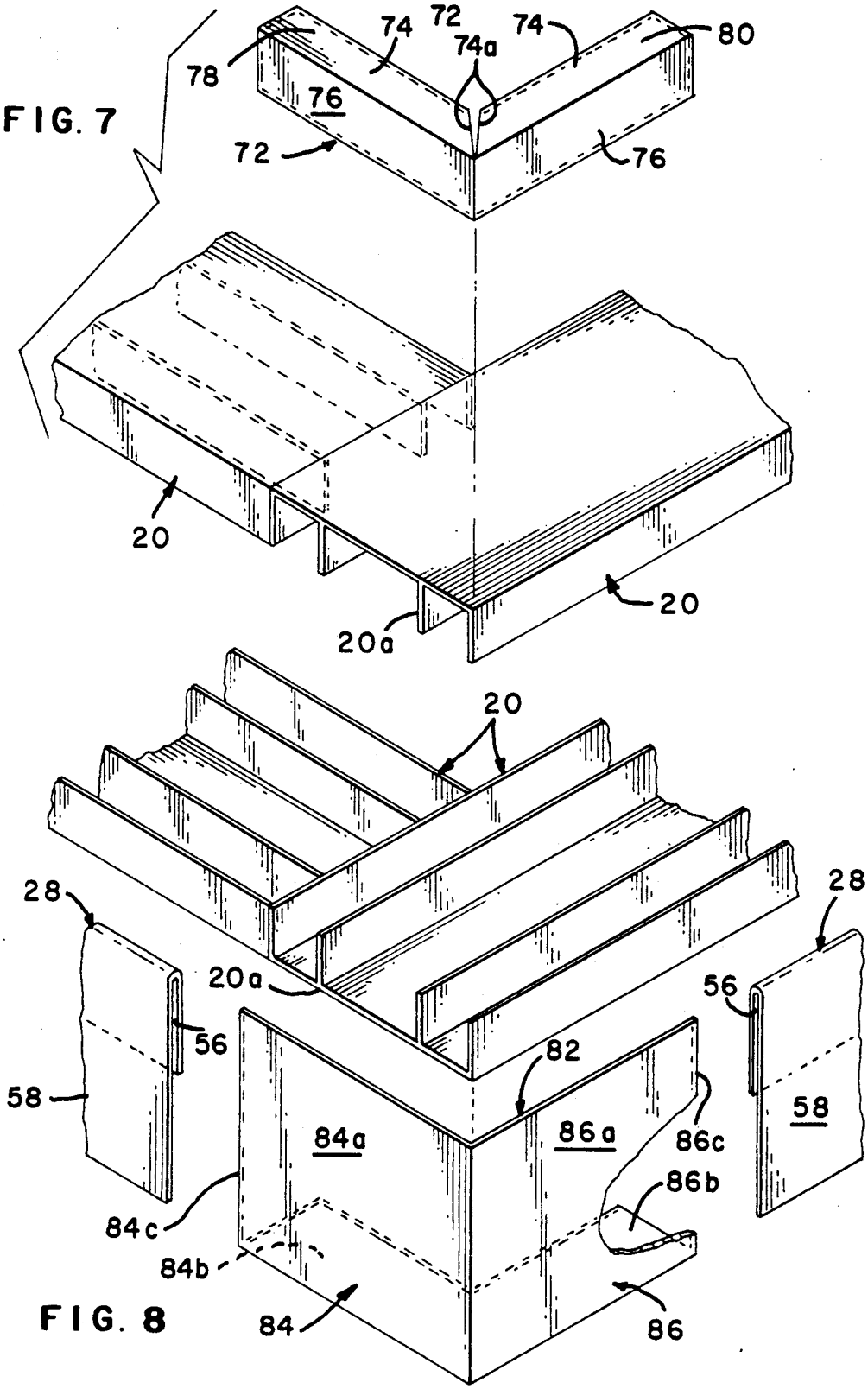
FIG. 8 is a perspective view of a floor cover member.

Similarly, end 20*a* of a floor member 20 may be exposed as illustrated in FIG. 8. In this case, a corner cover 82 is used in conjunction with trim strips 28. Corner cover 82 includes a pair of L-shaped sections 84,86 which are attached to and are at right angles to each other. Each section 84,86 includes vertical portion 84*a*, 86*a* respectively, and a short leg 84*b*,86*b* respectively which are at right angles to the respective vertical portions 84*a*,84*b*.

Corner cover 82 is positioned on wall 10 by sliding short legs 84*b*,86*b* under floor member 20 so that vertical portion 84 of section 84 covers end 2. Trim strips 28 are then positioned so that edges 84*c*,86*c* are within pockets 56 and behind outer portions 58.

Corner covers 82 may be modified (not shown) so that portion 84*a* of section 84 extends upwardly to cover end 20 of ceiling member 20, if desired.

As can be discerned, an interior wall kit has been disclosed. More particularly, the elements of the kit include the basic horizontal and vertical members which may be joined without fastening devices or tools. Additional kit components are also joined to the basic members without the use of tools. Further, the assembly can be done by non-skilled laborers with a minimum amount of training. The basic horizontal members include raceways for electrical wiring of all types.

I claim:

1. An interior modular wall for use within a building or the like, said wall comprising horizontal members with each having a pair of outer channels and a center channel with said channels being adapted to receive electrical and electronic wires and wiring harnesses, said members adapted to be attached to a floor and a ceiling in alignment with each other;

a plurality of vertical, I beam-shaped members positioned in and extending between said horizontal member and supported thereby;

a plurality of U-shaped support members having legs positioned in said outer channels of said horizontal member positioned on a floor and a bight extending over said center channel, said support members adapted to support panels which may be placed against the wall;

rectangular trim retaining clips having one end frictionally received between a leg of said support member and an adjacent sidewall of said horizontal member, and further having an outwardly extending free end; and trim strips having side by side layers defining a downwardly open pocket therebetween, said trim strips attached to said clips by receiving said free ends in said pocket, said strips adapted to cover said horizontal members positioned on a floor and a lower edge of a panel which may be positioned on said support members.

2. The wall of claim 1 wherein said trim strips are removable to provide access to said channels.

3. The wall of claim 1 wherein said I beam-shaped members are positioned in said center channels and with the free ends of said members being notched so that wires and wiring harnesses positioned in said center channel may pass therethru.

* * * * *